United States Patent [19]

Wen

[11] 4,387,892

[45] Jun. 14, 1983

[54] KENDO DUMMY WITH OSCILLATING SWORD

[76] Inventor: Cheng C. Wen, No,. 653, Ta Kan Liau, North Area, Tainan City, Taiwan

[21] Appl. No.: 306,109

[22] Filed: Sep. 28, 1981

[30] Foreign Application Priority Data

Jul. 17, 1981 [TW] Taiwan ..... 7012136

[51] Int. Cl.[3] ..... A63B 69/00

[52] U.S. Cl. ..... 272/76

[58] Field of Search ..... 40/414, 418, 419; 46/143, 148, 119, 120; 73/379, 380, 381; 84/484; 272/76; 273/1 F

[56] References Cited

U.S. PATENT DOCUMENTS

| | | | |
|---|---|---|---|
| 101,912 | 11/1916 | Parker | 46/119 |
| 694,335 | 2/1902 | Thenan et al. | 272/76 |
| 1,739,795 | 12/1929 | Krasheninnikoff | 272/1 F |
| 2,909,370 | 10/1959 | Fortney | 272/76 |
| 4,012,901 | 3/1977 | Jones | 84/484 |

*Primary Examiner*—Richard C. Pinkham
*Assistant Examiner*—William Honaker

[57] ABSTRACT

A kendo dummy comprises a trunk and an oscillating mechanism. The trunk supported by a supporting frame comprises a throat piece, a breast plate and a stomach plate. There are three buzzers provided respectively behind the throat piece, the breast plate and stomach plate. The buzzers will make sound when the kendo exerciser makes an effective thrust at the throat piece, the breast plate or stomach plate. The oscillating mechanism securedly connected to the lower portion of the trunk by a stationary member, comprises a shaft secured to the stationary member, an oscillating arm pivotally mounting on the shaft, a weight suspended beneath the shaft, a torsion spring between the stationary member and the oscillating arm, a rotating member sleeved on the shaft, and a bamboo sword connected to the rotating member. With the spring member and weight, the bamboo sword when subjected to the kendo exerciser's attack will oscillate clockwise and counterclockwise.

6 Claims, 3 Drawing Figures

KENDO DUMMY WITH OSCILLATING SWORD

BACKGROUND OF THE INVENTION

This invention relates to a kendo dummy capable of mechanically operating to replace the human body for practicing kendo.

On kendo practicing, an instructor is needed for practicing attack and defence. However, human body is not suitable for practicing such dangerous movements as straight thrust at throat, breast or stomach. Furthermore, in the absence of an instructor, the kendo exerciser alone can not do the practicing. The kendo dummy provided by the inventor is aimed to obviate the disadvantage of these two respects.

SUMMARY OF THE INVENTION

This invention relates to a kendo dummy capable of mechanically operating to replace the human body for practicing kendo.

Accordingly, one object of this invention is to provide a kendo dummy comprising an oscillating means which may do defencing and attacking for the kendo exerciser.

Another object of this invention is to provide a kendo dummy comprising at least three buzzers respectively behind a throat piece, a breast plate and a stomach plate whereby the buzzers will make sound when the kendo exerciser effect a mortal thrust at the throat piece, the breast plate and stomach.

This invention will be further described with reference to the accompanying drawings, the description being given by way of example only, not by way of limitation.

DETAILED DESCRIPTION OF THE INVENTION

Figure 1:
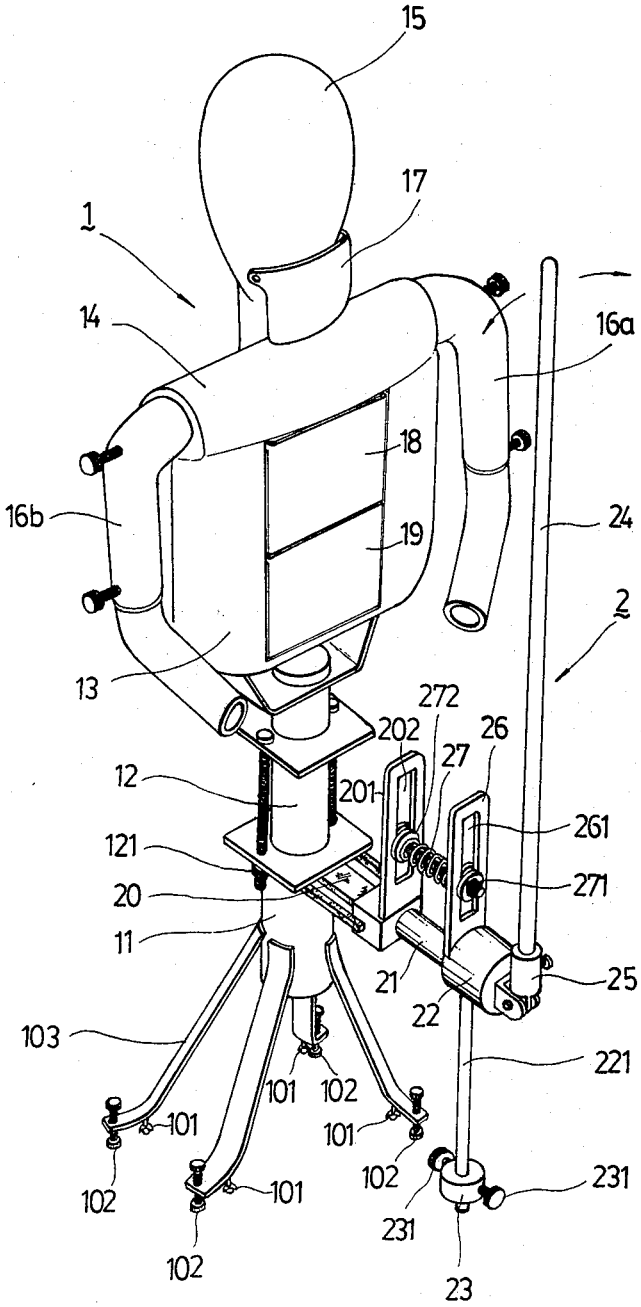
FIG. 1 is a perspective view of a preferable embodiment of this invention.
Figure 3:
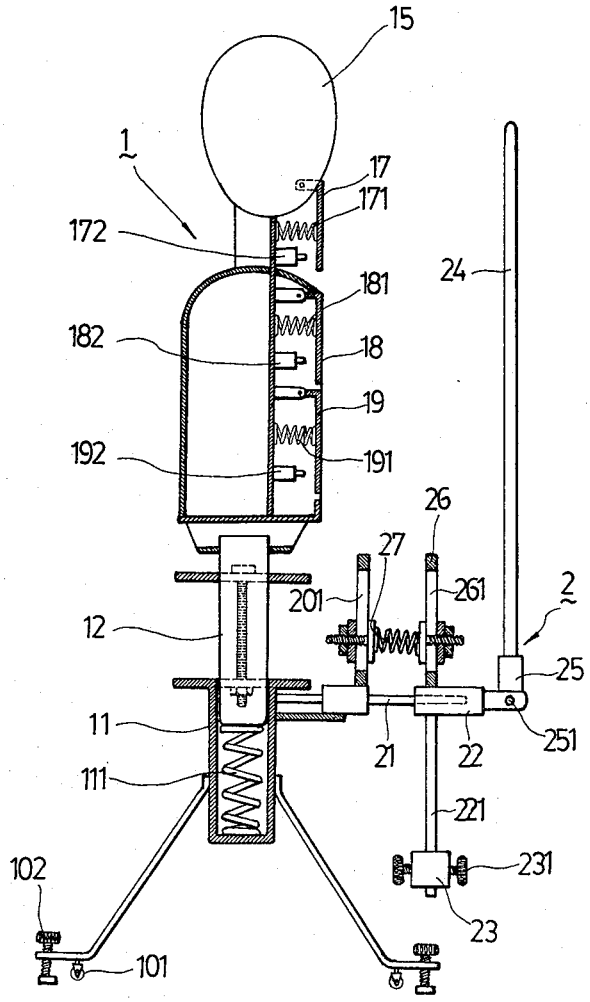
FIG. 3 is an exploded view of parts of a preferable embodiment of this invention.

As shown in FIG. 1, the kendo dummy of this invention comprises a trunk means 1 and an oscillating means 2. The trunk means 1 supported by a supporting frame comprises a head portion 15, a shoulder portion 14, a breast-stomach portion 13 and two arm portions 16*a* and 16*b*. The supporting frame 10 comprises a plurality of legs 103, an outer cylinder 11 connected to the upper ends of the legs 103, a spring member 111 (as shown in FIG. 3) within the hollow cylinder 11, an inner cylinder 12 partly inserted in the outer cylinder 11 to butt against the spring member 111 with the lower end thereof, and a fastening member 121 with which the relative position between the outer cylinder 11 and the inner cylinder 12 is adjustable. A plurality of rollers 101 are provided at the lower ends of the legs 103 for facilitating in moving the kendo dummy of this invention. A plurality of bolts 102 are further provided at the lower ends of the legs 103 for securing the kendo dummy of this invention to a desired place. The trunk means 1 further comprises a throat piece 17, a breast plate 18 and a stomach plate 19.

Figure 2:
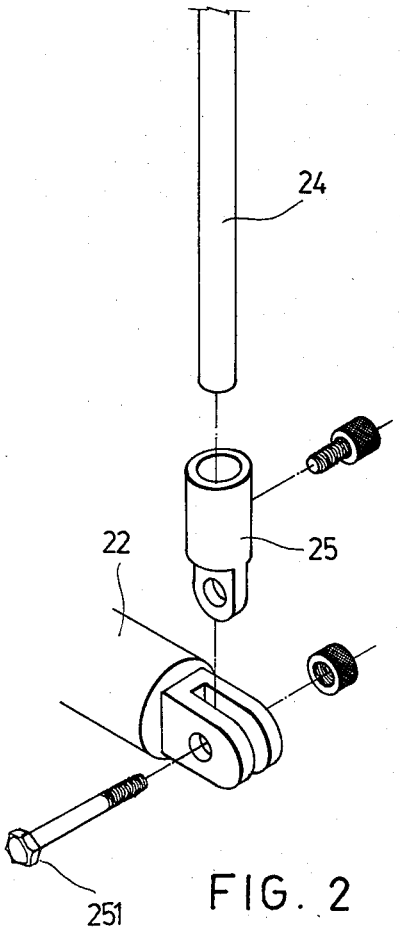
FIG. 2 is a side view of a preferable embodiment of this invention, partly sectioned.

As shown in FIG. 1, an oscillating means 2 of this invention is connected to the supporting frame 10 by means of a stationary member 20. As referred in FIGS. 2 and 3, the oscillating means 2 comprises a shaft 21 secured to the stationary member 20, an oscillating arm 26 pivotally mounted on the shaft 21, a suspending bar 221 extending downward from the oscillating arm 26, a weight 23 secured to the suspending bar 221 by means of a bolt 231, a rotating member 22 sleeved on the shaft 21, a holder 25 connected to the rotating member 22 by means of a bolt 251, and a bamboo sword 24 inserted in the holder 25. The bamboo sword 24 is fastened within the holder 25 by means of a fastening member. The stationary member 20 is provided with an upright board 201 cut with a longitudinal bore 202. The oscillating arm 26 which is cut with a longitudinal bore 261 corresponds to the upright board 201 in structure. A fastening member 271 extends through the bores 202 and 261; both ends of the fastening member 271 expose outside the bores 202 and 261. A torsion spring 27 sleeved on the fastening member 271 is confined between the upright board 201 and oscillating arm 26. The torsion spring 27 is adjustable by adjusting the fastening member 271 within the bores 202 and 261. As shown in FIG. 2, the inclination of the bamboo sword 24 is adjustable by means of the bolt 251. The oscillating speed of the bamboo sword 24 depends on the position of the weight 23 in relation to the suspending bar 221. If a higher oscillating speed is desired, the weight 23 must be fastened on the upper portion of the suspending bar 221. However, in a case where a lower oscillating speed is desired, the weight 23 must be fastened to the lower portion of the suspending bar 221. When the bamboo sword 24 is hit sidewise, the weight 23 will swing to effect a great tension on the torsion spring 27. The torsion spring member 27 and the weight 23 will combine to swing back the bamboo sword 24.

As shown in FIG. 3. the throat piece 17, the breast plate 18 and stomach plate 19 are pivotally provided on the trunk means 1. The throat plate 17, the breast plate 18 and stomach plate 19 are respectively supported by coil springs 171, 181 and 191. Three buzzers 172, 182 and 183 are respectively provided behind the throat plate 17, the breast plate 18 and stomach plate 19. If the straight thrust done by the kendo exerciser effects to push the throat piece 17, the breast plate 18 and the stomach plate 19 in contact with the top ends of the buzzers 172, 182 and 192, a sound will then be made. Thus, the kendo exerciser may know whether his thrust is effective or not.

As many apparently widely different embodiments of this invention may be made without departing from the spirit and scope thereof, it is to be understood that the invention is not limited to the specific embodiments thereof except as defined in the appended claims.

What I claim is:

1. A kendo dummy comprises a trunk means provided with a throat piece, a breast plate and a stomach plate a supporting frame to support a trunk means thereon; and an oscillating means connected to said trunk means by means of a stationary member, said oscillating means comprising a shaft secured to said stationary member, an oscillating arm pivotally mounted on said shaft, a suspending bar extending downward from said oscillating arm, a weight fastened to said suspending bar, a torsion spring extending from said stationary member to said oscillating arm, and a bamboo sword connected to said oscillating arm.

2. A kendo dummy as claimed in claim 1 wherein each of said throat piece, said breast plate and said stomach plate is supported by a coil spring.

3. A kendo dummy as claimed in claim 2 further comprising three buzzers respectively provided behind said throat piece, said breast plate and said stomach plate.

4. A kendo dummy as claimed in claim 1 wherein said weight is adjustable on said suspending bar.

5. A kendo dummy as claimed in claim 1 wherein said stationary member and said oscillating arm each have a bore provided therein to permit for said torsion spring to adjustablly slide therebetween.

6. A kendo dummy as claimed in claim 1 wherein the inclination of said bamboo sword is adjustable and said bamboo sword when hit is movable sidewise.

* * * * *